US005890437A

United States Patent [19]

Hill

[11] Patent Number: 5,890,437

[45] Date of Patent: Apr. 6, 1999

[54] COLLAPSIBLE PALLET WITH REINFORCING SLATS AND METHOD OF USING THE SAME

[76] Inventor: Melvin B. Hill, 408 Arbor Ridge Rd., Stone Mountain, Ga. 30087

[21] Appl. No.: 93,122

[22] Filed: Jun. 8, 1998

[51] Int. Cl.[6] ..... B65D 19/00

[52] U.S. Cl. ..... 108/51.3; 108/51.11; 108/56.1

[58] Field of Search ..... 108/51.11, 56.1, 108/56.3, 54.1, 57.21, 57.19, 57.17, 115, 162

[56] References Cited

U.S. PATENT DOCUMENTS

| | | | |
|---|---|---|---|
| 2,841,350 | 7/1958 | Chronister . | |
| 2,928,638 | 3/1960 | Parker | 108/51.3 |
| 3,036,802 | 5/1962 | Kitchell . | |
| 3,236,197 | 2/1966 | Rossner . | |
| 4,863,024 | 9/1989 | Booth . | |
| 5,076,175 | 12/1991 | Whatley, II | 108/51.11 |
| 5,690,037 | 11/1997 | Hill . | |

*Primary Examiner*—Jose V. Chen
*Attorney, Agent, or Firm*—Jones & Askew, LLP

[57] ABSTRACT

A collapsible pallet with reinforcing slats, and a method for reinforcing a collapsible pallet. The pallet comprises a flexible platform having an upper surface operative to receive a load. Laterally-displaced support blocks are affixed to a lower surface of the platform. Reinforcing slats are coupled to the upper surface of the platform to facilitate pallet handling. In one disclosed embodiment, the slats are inserted into pockets coupled to the platform and sized for receiving the slats. The pockets on the platform are transversely oriented with the support blocks. In a disclosed alternative embodiment, the slats may be removed from the transversely oriented pockets on the platform when the pallet is no longer in use and inserted into stowage pockets below the platform and aligned parallel with the support blocks. The stowage pockets are coupled to the vertical faces of the support blocks so that the platform and support blocks may be collapsed to store the pallet in a minimum of space. In another disclosed alternate embodiment, additional slats are inserted into another set of pockets coupled to the bottom of the support blocks to further reinforce the pallet. The pockets on the bottom of the support blocks are also transversely oriented with the support blocks. The slats may also be removed from these pockets in order to collapse the pallet.

22 Claims, 4 Drawing Sheets

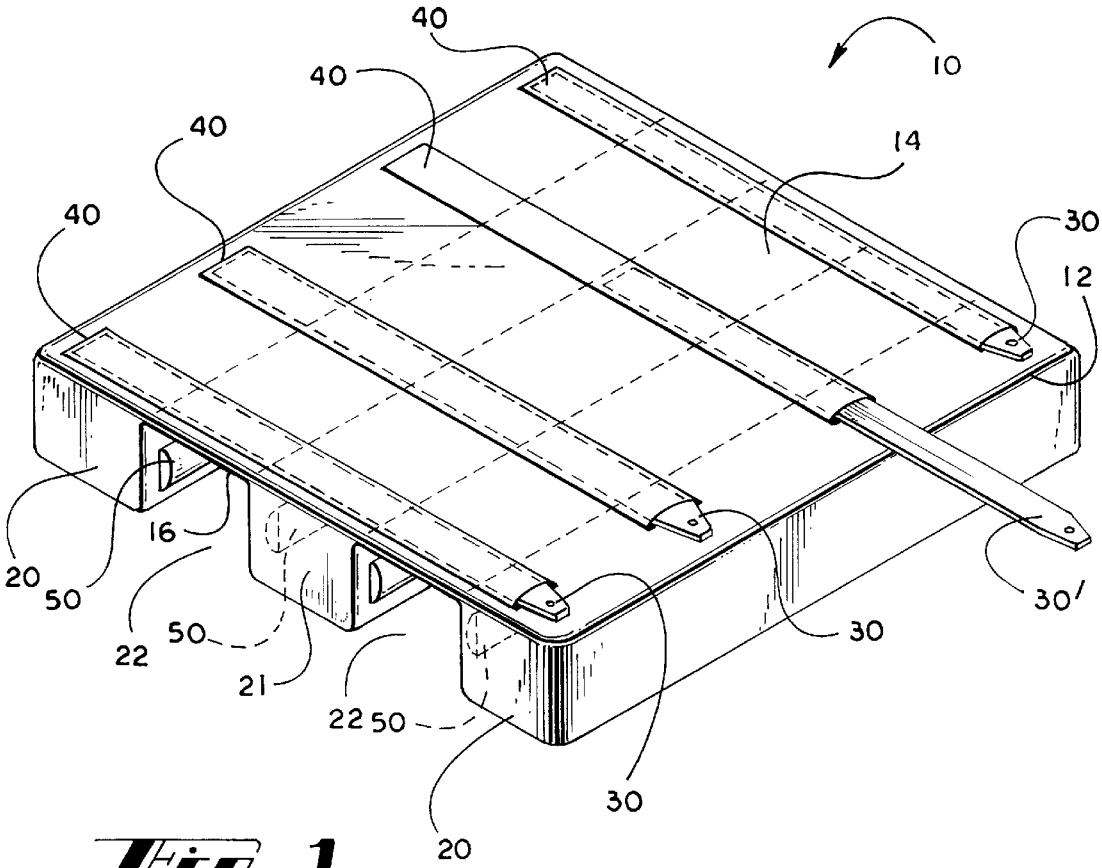
Fig. 1
Fig. 2
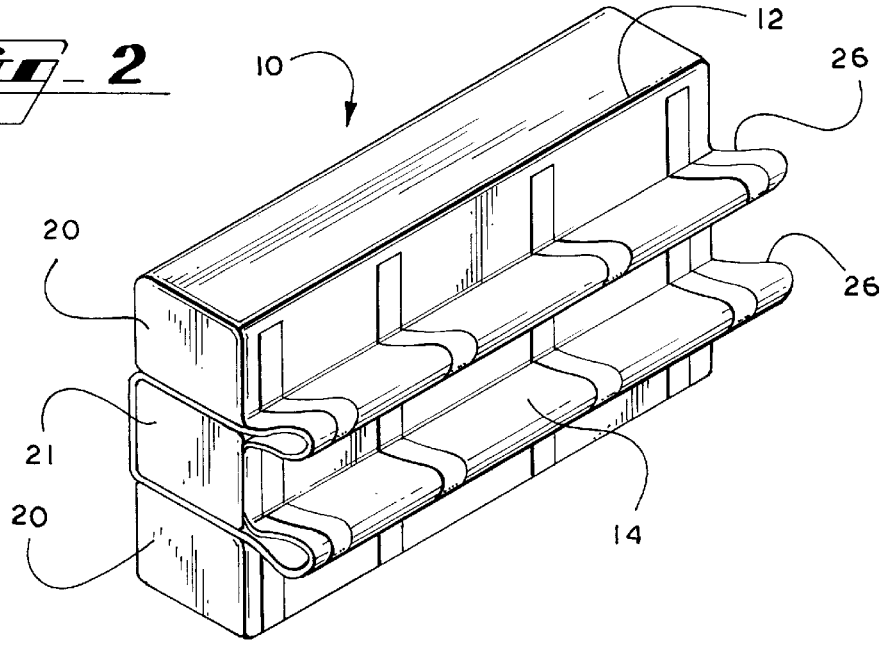

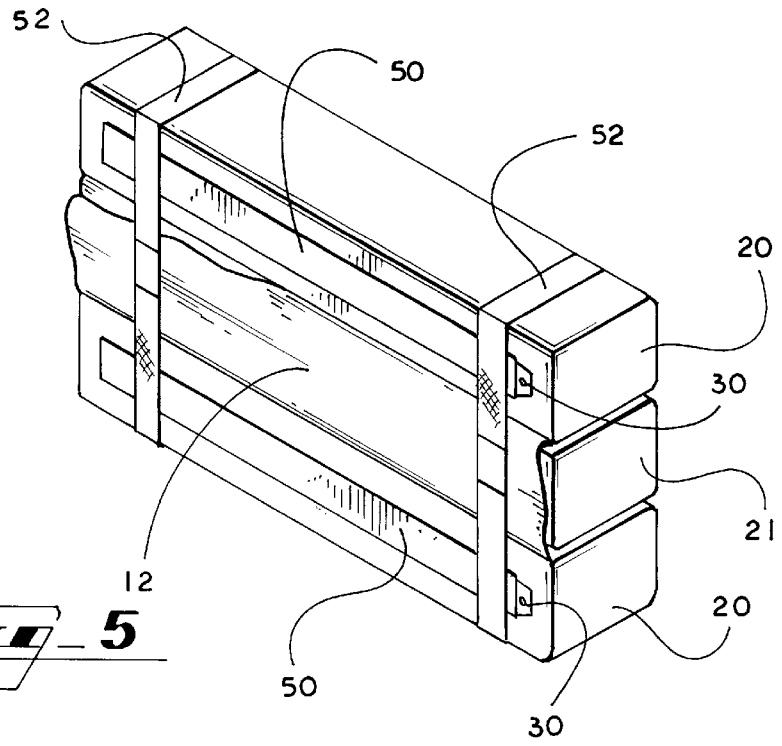
Fig. 5
Fig. 6
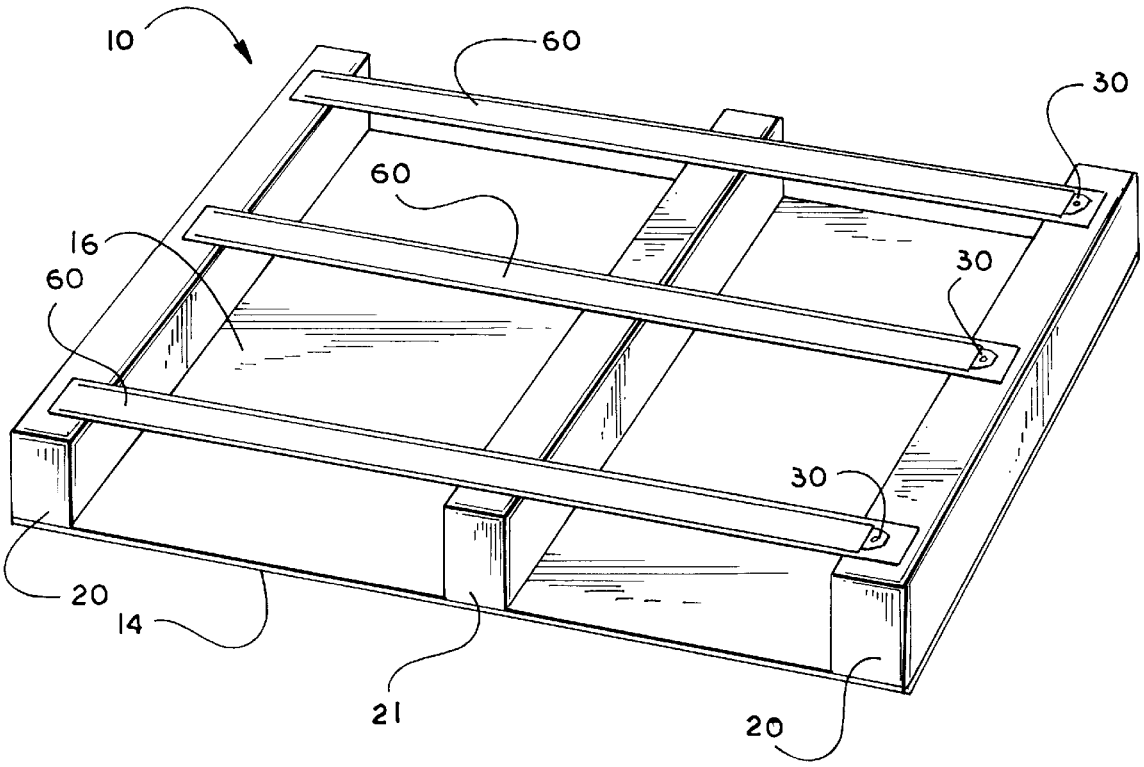

COLLAPSIBLE PALLET WITH REINFORCING SLATS AND METHOD OF USING THE SAME

FIELD OF THE INVENTION

The present invention relates to collapsible pallets capable of being folded up when no longer supporting loads. This invention more particularly pertains to reinforcing collapsible pallets to prevent their collapsing when supporting a load and to facilitate pallet handling.

BACKGROUND OF THE INVENTION

Pallets are widely used for supporting articles above the ground and for transporting these article from place to place. Articles such as consumer goods and manufactured parts are typically stored and shipped on pallets as cargo or freight. These pallets are adapted for use with material handling equipment such as forklifts. Forklifts facilitate the transportation of articles placed on pallets from one location to another. To move a loaded pallet from place to place, the forklift is maneuvered to insert its forks into channels beneath the lower surface of the pallet. The forklift can raise the forks thereby lifting the pallet above the ground. Once the loaded pallet is above the ground, the forklift is able to transport and position the pallet in any desired location.

Most commercially available pallets are conventional hard pallets which are typically made of wood. These wooden pallets are cumbersome and are not easily moved or stacked without assistance. Alternatives to these wooden pallets such as light-weight pallets are known. The development of light-weight pallets made of plastic or other materials was brought about by the desire to make conventional pallets easier to handle. Aside from being substantially heavier than the light-weight pallets, conventional pallets are also difficult to return to their original owner once the articles have been delivered. Ideally, the accumulated empty pallets should be returned to the supplier or manufacturer for reuse. However, due to their physical size, empty conventional pallets still take up considerable amounts of space on their return trip. Therefore, collapsible pallets were developed to save space as well as weight.

An example of a collapsible pallet is shown in my U.S. Pat. No. 5,690,037, the entire disclosure of which is incorporated herein by reference. Generally described, collapsible pallets according to that patent comprise a flexible platform affixed to rectangular support blocks. The platform is fabricated of a flexible but substantially inelastic material such as canvas or another kind of material having suitable strength and resistance to wear. This collapsible pallet has approximately the same length and width as a conventional wooden pallet. The support blocks are made of light-weight non-compressible material contained in a sleeve connected to the lower surface of the platform. The support blocks are displaced from one another defining a pair of parallel channels individually placed between adjacent support blocks. The channels are sized for receiving the lift forks of a lifting device such as a forklift. These collapsible pallets are made without nails or staples, making them particularly useful for storing and transporting articles such as beverage containers. Nails and staples often work themselves loose, and exposed nails and staples may pierce beverage containers on the bottom of a palletized load. Moreover, collapsible pallets weigh approximately half as much as conventional wooden pallets, are easier to handle, and allow more product to be moved for a given transportation cost.

Empty collapsible pallets are easily folded in order to collapse the pallet for storage and return shipment. To collapse these pallets once they have been emptied, the support blocks are stacked on top of one another. The loose portions of the platform may be eliminated by rotating the support blocks. A cluster of collapsed pallets is easily and inexpensively returned for reuse.

Manufacturers and suppliers palletize their products by placing their product on a pallet. The pallet may then be lifted with a forklift and placed in a cargo van, truck, train or any other mode of transportation suitable for cargo or freight. Alternatively, the pallet may be stored in a warehouse or bunker until being shipped at some later date. Consequently, an enormous supply of pallets is needed to meet the demands of manufacturers and suppliers who palletize their products for storage or shipment.

Presently, palletized articles are also placed on material handling equipment such as palletizing machines or sorting systems. For example, once a load of articles for a particular destination is palletized, the pallet may be placed on a conveyor to transport the pallet to the proper vehicle designated for that same destination. These pallet handling machines are primarily designed for use with conventional wooden pallets. Consequently, the transition to collapsible pallets has identified some inadequacies in collapsible pallets. These known collapsible pallets, when unfolded and placed on pallet handling equipment, may become hung-up or misaligned with respect to the drive rollers that move the pallet through the pallet handling machine. These hang-ups and misalignments are directly related to the nonrigid nature of such collapsible pallets. Except for the weight of a load on top of a collapsible pallet, there is no restraint preventing the support blocks from becoming misaligned when used with material handling equipment.

In response to the realized inadequacies of these earlier collapsible pallets and the preference of some pallet users not to modify existing forklifts for use with those collapsible pallets, it became clear there is a need for a collapsible pallet which is suitable for use with material handling equipment such as palletizing machines and sorting conveyors. This new collapsible pallet must have additional support to reinforce the collapsible pallet to facilitate pallet handling. What is needed is a collapsible pallet which has stiffeners to maintain the structural integrity of the collapsible pallet when used in conjunction with material handling equipment.

BRIEF SUMMARY OF THE INVENTION

The present invention alleviates or solves the above-described problems in the prior art by providing an improved collapsible pallet and process. The present device also satisfies the need for an inflexible collapsible pallet usable with conventional pallet handling equipment.

In accordance with the invention, this object is accomplished by providing a reinforced collapsible pallet of the above kind in that slats are positioned between the support blocks. The effect of the slats is that when the platform of the pallet is extended and positioned for receiving a load, the slats prevent the support blocks from collapsing against one another. In the preferred embodiment, the slats are positioned substantially transverse between the blocks. However, the slats are capable of being detached from the support blocks. Once the slats are no longer coupled to the support blocks, the slats may be secured along with the platform and the support blocks when the pallet is collapsed. In the preferred embodiment, the slats are received into pockets juxtaposed to the support blocks.

In one embodiment, the collapsible loading pallet for supporting and transporting a load comprises a flexible platform formed of flexible and substantially inelastic material. The platform has an upper surface operative to receive the load when the platform is in an erect position. The platform is sufficiently flexible to permit bundling of the pallet into a collapsed position. A plurality of elongated support blocks are laterally spaced apart in relation to one another and affixed to a lower surface of the flexible platform. The support blocks define at least two parallel channels between the blocks for selectively receiving and engaging the separated forks of a lifting device such as a conventional forklift when the pallet is in the erect position. When the pallet is in the collapsed position, the blocks rest approximately alongside one another. A plurality of elongated reinforcing slats for reinforcing the pallet when in the erect position have a length coextensive with the platform. The invention also comprises pockets for detachably coupling the slats to the platform substantially transverse to the blocks. Upon removal of the slats from the pockets, the platform and blocks may be collapsed such that the pallet is stored in a minimum of space.

In another embodiment, the present invention further comprises storage pockets for storing the slats with the pallet when in the collapsed position and when the slats are no longer reinforcing the pallet. The storage pockets are coupled to the blocks such that when the pallet is in the collapsed position the slats are parallel alongside the blocks.

In yet another embodiment, the present invention further comprises a second set of pockets for detachably coupling slats to the pallet. The second set of pockets is coupled to the blocks and is oriented substantially transverse to the blocks.

A reinforced collapsible pallet formed in accordance with the present invention has a number of advantages. An important advantage of the novel collapsible pallet is its ability to provide a rigid platform for receiving and supporting a load.

Accordingly, an object of this invention is to provide an improved pallet that overcomes the aforementioned inadequacies of the prior art pallets.

Another object of the present invention is to provide a reinforced collapsible pallet to facilitate pallet handling.

Still another object of the present invention is to provide a structurally simple and economical device for supporting and transporting a load.

Yet another object of the present invention is to provide a pallet for supporting and transporting a load, the pallet being collapsible into a minimum of space when not carrying a load.

The foregoing has broadly outlined some of the more pertinent objects and features of the invention. These should be construed to be merely illustrative of some of the more prominent features and applications of the intended invention. Many other beneficial results can be obtained by applying the disclosed invention in a different manner or by modifying the disclosed embodiments. Accordingly, other objects and a more comprehensive understanding of the invention may be obtained by referring to the detailed description of the preferred embodiment taken in conjunction with the accompanying drawings, in addition to the scope of the invention defined by the claims. For a more succinct understanding of the nature and objects of the present invention, reference should be directed to the following detailed description taken in connection with the accompanying drawings.

BRIEF DESCRIPTION OF THE DRAWINGS

FIG. 1 is a top pictorial view of a collapsible pallet according to one embodiment of the present invention, showing slats in pockets located on the platform of the collapsible pallet.

FIG. 2 is a pictorial view of the embodiment in FIG. 1, showing the pallet folded for storage or shipment.

FIG. 5 is a pictorial view of the embodiment as in FIG. 1, showing the pallet collapsed and bundled for storage and shipping.

FIG. 6 is a bottom pictorial view of another embodiment of the present invention, showing a pallet with transverse slats coupled to the bottom of the support blocks.

DETAILED DESCRIPTION OF THE PREFERRED EMBODIMENTS

Figure 3:
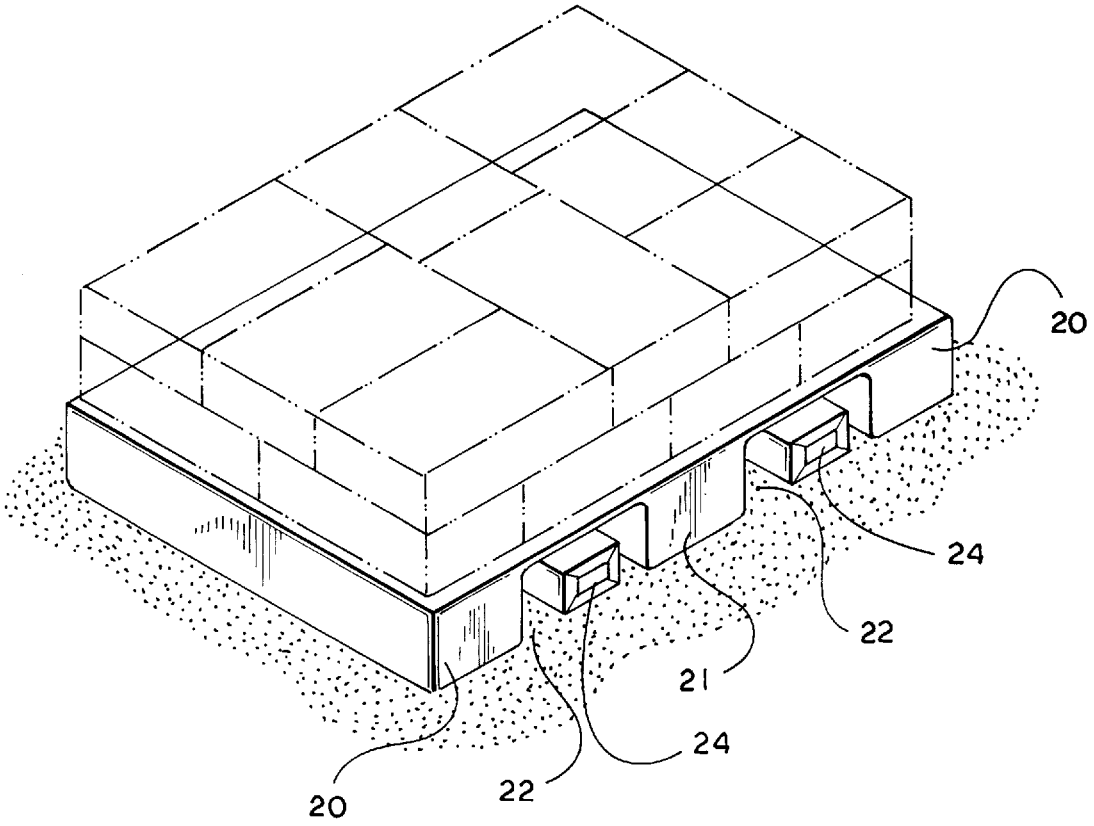
FIG. 3 is front pictorial view showing the pallet as in FIG. 1, engaged by forks of a forklift with a load shown in phantom on the pallet.

As shown in FIG. 1, a collapsible pallet shown generally at 10 comprises a flexible platform 12 formed of a flexible but substantially inelastic material, such as canvas or another kind of cloth having suitable strength and resistance to wear. The platform has an upper surface 14 operative to receive the load and a lower surface 16. Rectangular support blocks 20 are attached to the lower surface. The blocks are contained in corresponding sleeves connected to the lower surface. In the preferred embodiment, a pair of outer support blocks 20 is attached to the lower surface along two opposite sides of the platform. Another intermediate support block 21 is attached to the lower surface at approximately the midpoint between the two outer support blocks. The support blocks maintain the platform spaced a distance above the ground so that the load is elevated above the ground as shown in FIG. 3.

The support blocks 20 and 21 are mutually parallel and spaced apart from one another to define two parallel channels 22 which extend along the entire length of the pallet. The channels, which are located between the blocks, selectively receive and engage the laterally separated forks 24 of a conventional lifting mechanism as best shown in FIG. 3. A complete lifting mechanism, such as a forklift, is not shown. It should be understood that the lifting mechanism may be any type of apparatus capable of moving pallets from place to place in a warehouse or other facility. As shown in FIGS. 1 and 3, the channels 22 are provided on opposite sides of the intermediate support block 21 at the midpoint of the platform 12.

FIG. 2 illustrates the collapsed position of the pallet 10. The platform 12 is sufficiently flexible to permit folding of the pallet. The support blocks 20, 21 rest approximately alongside one another when the pallet is in the collapsed position. The excess portions of the material of the platform form loose folds 26 which may be taken up by rotating the support blocks (not shown).

Figure 8:
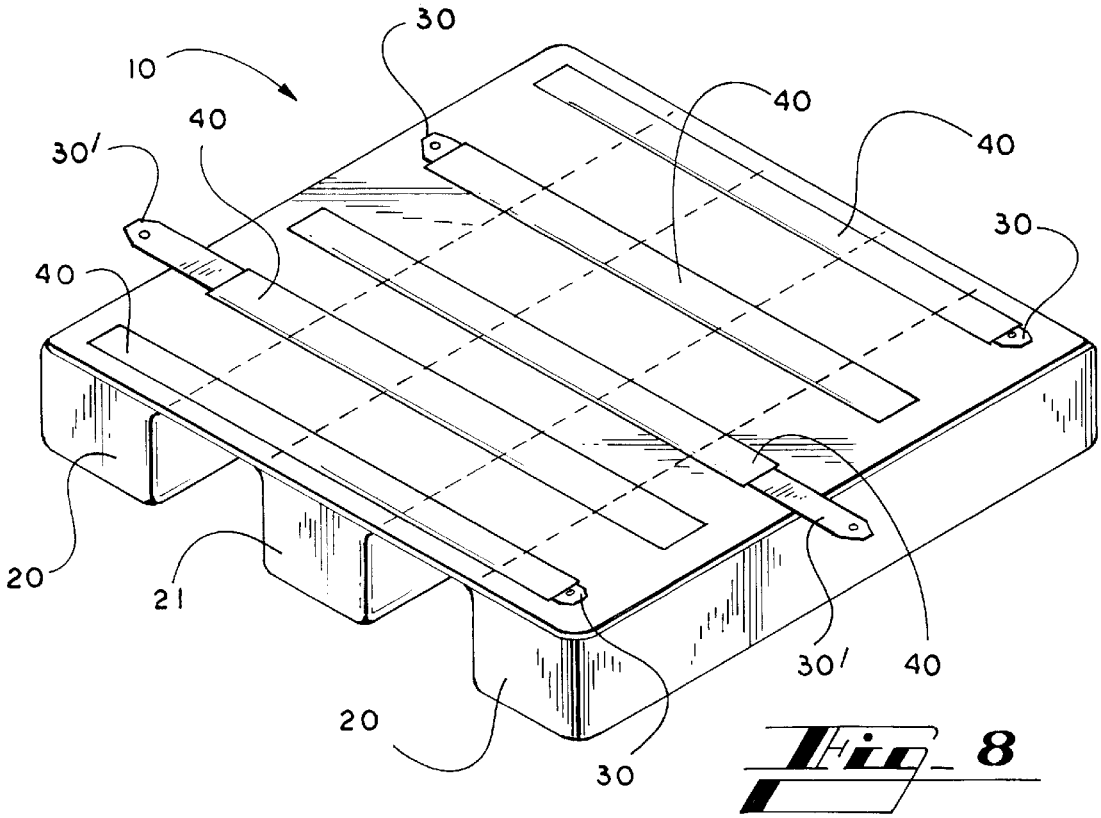
FIG. 8 is a top pictorial view of a modified version of the embodiment shown in FIG. 1, showing slats in pockets located on the platform of the collapsible pallet.

The collapsible pallet 10 further comprises elongated reinforcing slats 30 for reinforcing the pallet when the pallet is unfolded for use into the erect position. As shown in FIGS. 1 and 8, the slats have a length coextensive with the width of the platform 12 and extend at substantially a right angle to the length of the support blocks beneath the platforms.

While any convenient material may be used for the slats, wood has been used satisfactorily to provide the necessary reinforcement to the pallet 10. Pockets 40 generally corresponding in length with the slats are coupled to the upper surface of the platform as shown in FIGS. 1 and 8 for detachably coupling the slats to the pallet. The pockets 40 should be coupled to the platform substantially transverse to the blocks 20. The pockets each have an open end for inserting one of the slats corresponding with each of the pockets when the pallet is unfolded for receiving a load. The slats may then be removed from the pockets on the platform when the pallet is no longer loaded and is to be collapsed. FIG. 1 illustrates one of the slats 30' partially removed from its pocket while the remaining pockets have a slat completely inserted through the open end of each pocket. Removal of the slats from the pockets allows the blocks and the platform to be collapsed to the configuration shown in FIG. 2, so that the pallet 10 may be stored in a minimum of space.

Figure 4:
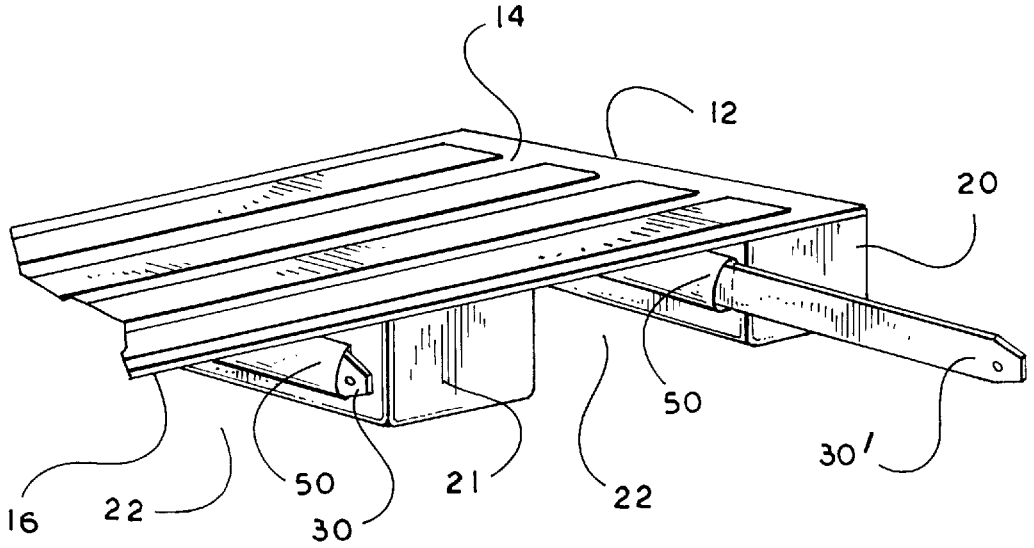
FIG. 4 is a partial front view of the embodiment as in FIG. 1, showing the stowing of slats on the pallet.

In a preferred embodiment, as shown in FIGS. 1 and 4, the collapsible pallet 10 further comprises elongated stowage pockets 50 for storing the slats with the pallet 10 when the slats are detached from the pockets and the pallet is to be placed into the collapsed position. The stowage pockets 50 also correspond in length with the slats 30 and have an open end for receiving a corresponding slat. The stowage pockets 50 are coupled to the vertical sides of the blocks 20 and 21 as shown in FIGS. 1 and 4. FIG. 4 illustrates one of the slats 30' partially removed from a stowage pocket while the remaining slats 30 are inserted in their respective stowage pockets.

To stow the slats, in preparation for collapsing the pallet, each of the slats is removed from the pockets 40 on the top of the platform and inserted into the corresponding stowage pocket 50. In the collapsed position, the stowage pockets hold the slats parallel alongside the blocks as shown in FIG. 5. The collapsed pallet may be bound by a pair of straps or similar fasteners 52 wrapped around the collapsed pallet as shown in FIG. 5 to ensure that the pallet is maintained in a minimum of space. When the pallet is to be unfolded and placed into the erect position, the slats are removed from the open ends of the stowage pockets 50 and then inserted back into the pockets 40 on the upper surface of the platform to facilitate pallet handling.

In one embodiment, the pockets 40, 50 of the present invention are formed in the flexible material of the platform 12 and in the sleeves connecting each of the support blocks 20, 21 to the lower surface 16. Alternatively, each pocket 40, 50 may be separately formed from the flexible material and overlaid on the surface of the material covering the platform or the blocks. The pockets may be made of the same material as the platform 12 and the sleeves. Such pockets which overlay the surface of the textile material are secured to the pallet by any suitable means such as stitching the pocket to the textile material of the pallet. The stitching should extend along the circumference of each of the pockets.

Figure 7:
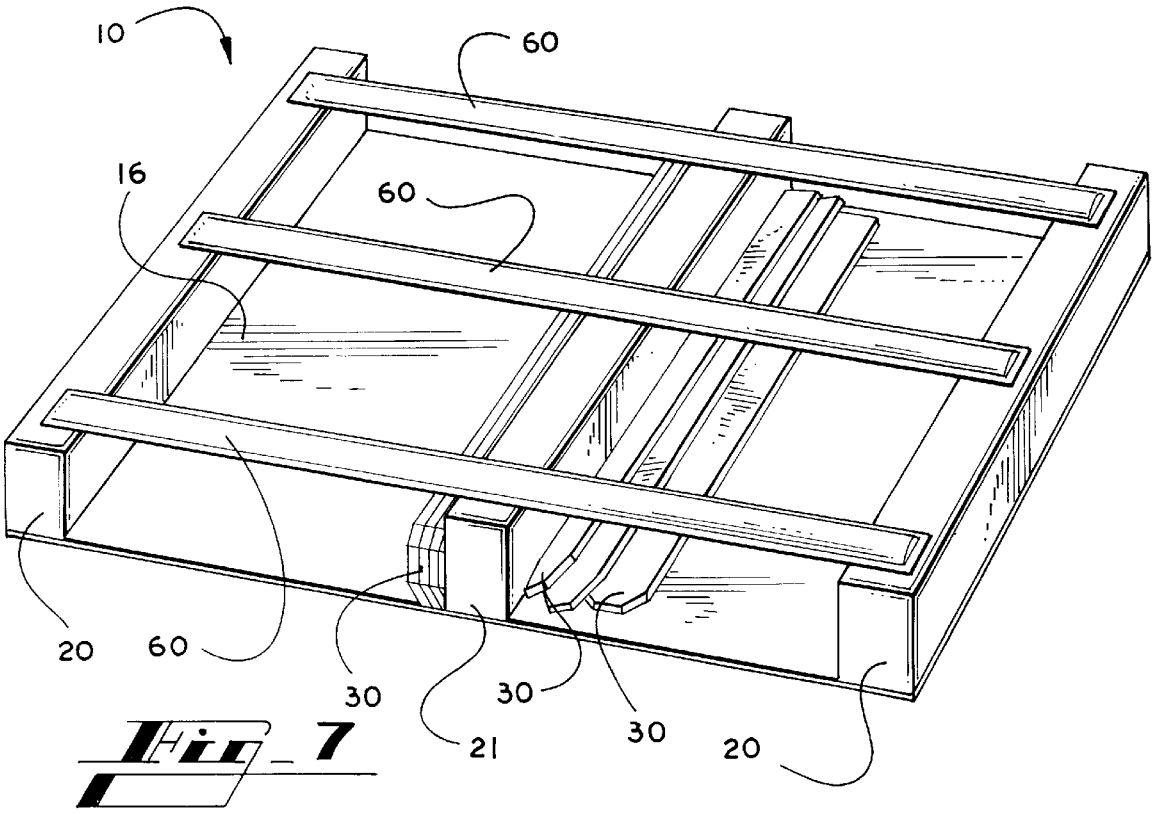
FIG. 7 is a bottom pictorial view of the embodiment as in FIG. 6, showing the slats removed and stowed.

In a preferred embodiment as shown in FIGS. 6 and 7, the pallet 10 of the present invention further comprises a second set of pockets 60 for detachably coupling slats to the blocks 20, 21. The pockets 60 are also substantially transverse to the blocks 20, 21 The pockets 60 are coupled to the blocks 20, 21 beneath the platform as shown in FIGS. 6 and 7. FIG. 6 illustrates slats 30 inserted into the pockets 60. FIG. 7 illustrates the slats 30 removed from pockets 40, 60 and gathered on the lower surface. The slats are aligned adjacent with the intermediate block 21 so that the block 20 and platform may be folded to collapse the pallet. The pockets 60 are preferably separately formed from the same material as pockets 40, 50. The pockets 40, 60, in conjunction with slats 30 inserted therein, accomplish the object of the present invention by providing improved structural integrity of the collapsible pallet 10 when being used with material handling equipment such as roller conveyors that move pallets during palletizing or other operations.

FIG. 8 illustrates an embodiment where each pocket 40 on the upper surface 14 of the platform 12 alternates between having an open end adjacent to the outermost support blocks on opposite sides of the pallet. In this embodiment, slats are inserted into the pockets 40 from both sides of the pallet 10. Slats 30' are partially removed from their respective pocket.

The use of the pallet 10 as described above constitutes an inventive method of the present invention in addition to the pallet 10 itself. In practicing the method of reinforcing the collapsible pallet 10 as described above, the steps include providing a flexible platform 12 formed of a flexible textile material and having an upper surface 14 operative to receive the load. The method then includes the step of providing a plurality of support blocks 20, 21 affixed in laterally spaced apart relation on a lower surface 16 of the platform. The method also includes the step of laterally extending the blocks with respect to each other such that the platform is substantially flat for receiving the load. The invention also includes the step of detachably coupling slats 30 to the platform substantially transverse to the support blocks. The method of the present invention then includes the step of removing the slats from the platform such that the pallet may be collapsed. The method then includes the step of folding the platform and the blocks such that the pallet may be collapsed and stored in a minimum of space.

The method of the present invention may further comprise the step of returning the collapsed pallet to where the pallet once came for reuse. Also, the method may further comprise the step of detachably coupling slats substantially transverse to the blocks to reinforce the pallet for receiving and supporting the load. The method then may further comprise the step of removing the slats coupled to the blocks when collapsing the pallet. The method of the present invention may further comprise the step of stowing the slats adjacent the vertical faces of the blocks.

In one embodiment of the method of the present invention, the step of folding comprises stacking the blocks 20, 21 alongside one another. The step of folding may further comprise wrapping the blocks and the platform with a fastener 52.

The present invention has been illustrated in great detail by the above specific examples. It is to be understood that these examples are illustrative embodiments and that this invention is not to be limited by any of the examples or details in the description. Those skilled in the art will recognize that the present invention is capable of many modifications and variations without departing from the scope of the invention. Accordingly, the detailed description and examples are meant to be illustrative and are not meant to limit in any manner the scope of the invention as set forth in the following claims. Rather, the claims appended hereto are to be construed broadly within the scope and spirit of the invention.

What is claimed is:

1. A collapsible loading pallet for transporting a load by means of a lifting mechanism having a pair of laterally separated forks and for supporting the load in elevated relation to the ground when the pallet rests on the ground, said pallet comprising:

a platform formed of flexible material and having an upper surface operative to receive the load when said platform is in an erect position, said platform permitting the folding of said pallet into a collapsed position;

a plurality of elongated support blocks affixed in laterally spaced apart relation on a lower surface of said platform, said blocks defining at least two parallel channels between said blocks for selectively receiving and engaging the separated forks when in said erect position, and said blocks resting approximately alongside one another when said pallet is in said collapsed position;

a plurality of elongated reinforcing slats for reinforcing said pallet when in said erect position, said slats having a length coextensive with said platform; and means for detachably coupling said slats to said platform, said coupling means being aligned substantially transverse to said blocks, whereby upon removal of said slats from said coupling means, said platform and said blocks may be collapsed such that said pallet is stored in a minimum of space.

2. The pallet of claim 1 wherein said blocks are contained in corresponding sleeves connected to said lower surface of said platform.

3. The pallet of claim 1 wherein said detachable coupling means is a first plurality of elongated pockets, said first pockets each having an open end such that each said slat corresponding with each said first pocket may be inserted and removed through said open end thereof.

4. The pallet of claim 3 wherein said first pockets generally correspond in length with said slats.

5. The pallet of claim 3 wherein said first pockets are formed in said flexible material on said upper surface of said platform.

6. The pallet of claim 3 wherein said first pockets overlay said platform and are secured to said flexible material.

7. The pallet of claim 1 further comprising a second means for detachably coupling said slats to said blocks, said second coupling means being aligned substantially transverse to said blocks.

8. The pallet of claim 7 wherein said second coupling means is a second plurality of elongated pockets generally corresponding in length with said slats.

9. The pallet of claim 8 wherein said second pockets generally correspond in length with said slats.

10. The pallet of claim 1 further comprising stowage means for storing said slats with said pallet when in said collapsed position and when said slats are detached from said coupling means, said stowage means being aligned with said blocks such that when said pallet is in said collapsed position said slats are parallel alongside said blocks.

11. The pallet of claim 10 wherein said stowage means comprises a third plurality of elongated pockets, said third pockets each having an open end such that each said slat corresponding with each said third pocket may be inserted and removed through said open end thereof.

12. The pallet of claim 11 wherein at least one of said third pockets is formed in said flexible material on a vertical side of one of said blocks.

13. The pallet of claim 11 wherein each said third pocket overlays and is secured to a vertical side of one of said blocks.

14. The pallet of claim 11 wherein said third pockets generally correspond in length with said slats.

15. A collapsible loading pallet for transporting a load by means of a lifting mechanism having a pair of laterally separated forks and for supporting the load in elevated relation to the ground when said pallet rests on the ground, said pallet comprising:

a platform formed of flexible material and having an upper surface operative to receive the load when said platform is in an erect position, said platform permitting the folding of said pallet into a collapsed position;

a plurality of support blocks affixed in laterally spaced apart relation on a lower surface of said platform, said blocks defining at least two parallel channels between said blocks for selectively receiving and engaging the separated forks when in said erect position, and said blocks resting approximately alongside one another when said pallet is in said collapsed position;

a plurality of elongated reinforcing slats for reinforcing said pallet when in said erect position, said first slats having a length coextensive with said platform;

first means for detachably coupling some of said slats to said platform, said first coupling means being aligned substantially transverse to said blocks; and second means for detachably coupling the remainder of said slats to said blocks, said second coupling means being aligned substantially transverse to said blocks, whereby upon removal of said slats from said first and second coupling means, said platform and said blocks may be collapsed such that said pallet is stored in a minimum of space.

16. In a collapsible loading pallet for supporting and transporting a load, a method for reinforcing said pallet comprising the steps of:

providing a platform formed of flexible material and having an upper surface operative to receive the load;

providing a plurality of support blocks affixed in laterally spaced apart relation on a lower surface of said platform;

laterally extending said blocks with respect to each other such that said platform is substantially flat for receiving the load;

detachably coupling slats to said platform substantially transverse to said blocks so as to make said platform and said pallet rigid;

removing said slats from said platform after loaded use of said pallet, such that said pallet may be collapsed; and then folding said platform and said blocks such that said pallet may be collapsed and stored in a minimum of space.

17. The method of claim 16 wherein the step of folding comprises stacking said blocks alongside one another.

18. The method of claim 17 wherein the step of folding further comprises wrapping said blocks and said platform with a fastener.

19. The method of claim 16 further comprising the step of returning said collapsed pallet to where said pallet once came for reuse.

20. The method of claim 16 further comprising the step of detachably coupling slats to said blocks, said slats being aligned substantially transverse to said blocks to reinforce said pallet for receiving and supporting the load.

21. The method of claim 20 further comprising the step of removing said slats coupled to said blocks when collapsing said pallet.

22. The method of claim 16 further comprising the step of stowing said slats on vertical faces of said blocks, said slats resting alongside and aligned with said blocks when said pallet is collapsed.

* * * * *